US010653221B2

(12) United States Patent
Larsh

(10) Patent No.: US 10,653,221 B2
(45) Date of Patent: May 19, 2020

(54) JEWELRY STORAGE AND DISPLAY APPARATUS

(71) Applicant: Nancy Larsh, Indianapolis, IN (US)

(72) Inventor: Nancy Larsh, Indianapolis, IN (US)

( * ) Notice: Subject to any disclaimer, the term of this patent is extended or adjusted under 35 U.S.C. 154(b) by 468 days.

(21) Appl. No.: 15/397,105

(22) Filed: Jan. 3, 2017

(65) Prior Publication Data

US 2017/0208912 A1 Jul. 27, 2017

Related U.S. Application Data

(63) Continuation of application No. PCT/US2015/003894, filed on Jul. 2, 2015.

(60) Provisional application No. 62/020,353, filed on Jul. 2, 2014.

(51) Int. Cl.

| | |
|---|---|
| ***A47F 7/02*** | (2006.01) |
| ***A45C 11/16*** | (2006.01) |
| ***A47G 29/087*** | (2006.01) |
| ***A47G 29/08*** | (2006.01) |

(52) U.S. Cl.

CPC ..... *A45C 11/16* (2013.01); *A47F 7/02* (2013.01); *A47G 29/08* (2013.01); *A47G 29/087* (2013.01)

(58) Field of Classification Search

CPC ... A47F 7/03; A47F 7/02; A45C 11/16; A47G 29/08; A47G 29/087

USPC ..... 206/6.1

See application file for complete search history.

(56) References Cited

U.S. PATENT DOCUMENTS 258,720 A * 5/1882 Dickson ..... D05B 91/14 223/107
2,962,156 A * 11/1960 Adams ..... A45C 11/16 206/559
3,003,997 A * 10/1961 Intermill ..... A45C 9/00 206/6.1
3,339,745 A * 9/1967 Sugerman ..... A47F 7/02 211/85.2
3,381,782 A * 5/1968 Ikelheimer ..... A45C 13/02 190/110
3,997,050 A * 12/1976 Patterson ..... A45C 11/16 206/566
4,058,356 A * 11/1977 Michal ..... A47F 7/02 206/566
4,111,341 A * 9/1978 Carrozo ..... A45C 11/00 206/227
4,141,453 A * 2/1979 Hanan ..... A47F 7/02 211/163
4,264,013 A 4/1981 Vollmer
4,324,446 A * 4/1982 LeSage ..... A45C 11/16 206/566
4,637,513 A * 1/1987 Eldrige, Jr. ..... A61B 17/06161 206/363
4,735,246 A * 4/1988 Niehaus ..... A45C 7/0095 206/6.1
4,775,053 A * 10/1988 Geiger ..... A47F 7/02 211/85.2

(Continued)

*Primary Examiner* — Ernesto A Grano

(74) *Attorney, Agent, or Firm* — Woodard, Emhardt, Henry, Reeves and Wagner LLP

(57) ABSTRACT

Described are unique jewelry storage and display apparatuses that can be modular and than can include modules adapted beneficially to store and display differing types of jewelry. Also described are individual modules that can be used separately or combined to form an overall combined jewelry storage and display apparatus.

15 Claims, 10 Drawing Sheets

(56) References Cited

U.S. PATENT DOCUMENTS 4,776,650 A * 10/1988 Ferenzi ..... A47B 67/02 211/85.2
4,787,516 A * 11/1988 Morrison ..... A47F 7/02 206/205
4,848,585 A * 7/1989 Snyder ..... A45C 11/16 206/566
4,848,586 A * 7/1989 Jasik ..... A45C 11/16 206/566
4,917,235 A * 4/1990 Feiler ..... A47F 7/022 206/566
4,936,466 A * 6/1990 Nava ..... A47F 7/02 206/566
4,958,727 A * 9/1990 Bergeron ..... A45C 9/00 206/489
4,966,287 A * 10/1990 Snyder ..... A45C 11/16 211/113
4,978,001 A * 12/1990 Nelson ..... A45C 11/16 206/6.1
5,033,625 A * 7/1991 Campbell ..... A47F 7/02 206/495
5,087,105 A * 2/1992 White ..... A47F 7/02 206/566
5,168,986 A * 12/1992 Stenhouse ..... A47F 7/02 206/45.24
5,363,953 A * 11/1994 Carter ..... A45C 11/16 206/495
5,465,852 A * 11/1995 Koks ..... A47F 7/02 211/85.26
5,511,873 A * 4/1996 Mech ..... A45C 11/16 206/566
5,551,772 A * 9/1996 Keffer ..... A47F 7/02 206/6.1
5,682,987 A * 11/1997 Herzog ..... A45C 11/16 206/301
5,727,698 A * 3/1998 Lai ..... A47F 7/02 211/87.01
D393,542 S * 4/1998 Thompson ..... D3/294
D418,347 S * 1/2000 Dragonette ..... D6/559
6,158,578 A * 12/2000 Greiner ..... A47F 5/10 206/6.1
6,161,686 A * 12/2000 Simon ..... A45C 11/16 206/6.1
6,926,136 B1 * 8/2005 Lynch-Bass ..... A45C 11/16 206/6.1
7,182,416 B1 * 2/2007 Greiner ..... A45C 11/16 206/6.1
7,389,868 B2 6/2008 Lewand et al.
7,600,619 B2 * 10/2009 Sapyta ..... A45C 7/0054 190/107
8,070,025 B1 * 12/2011 Nelson ..... A47G 25/14 211/85.2
D721,490 S * 1/2015 Batton ..... D3/271.5
9,131,789 B1 * 9/2015 Williams ..... A47F 7/02
9,392,889 B2 * 7/2016 Trainor-Smith ..... A47F 7/02
9,723,904 B1 * 8/2017 Taylor ..... A45C 11/16
10,092,116 B1 * 10/2018 Johns ..... A47F 7/022
2004/0016670 A1 * 1/2004 Lewand ..... A45C 11/16 206/459.5
2006/0124255 A1 * 6/2006 Manzella ..... E06B 9/24 160/371
2006/0180481 A1 * 8/2006 McGaughey, Sr. ..... A47F 7/02 206/6.1
2006/0201825 A1 * 9/2006 Mobley ..... A47F 7/02 206/6.1
2007/0057606 A1 * 3/2007 Christian ..... A45C 11/16 312/245
2008/0129171 A1 6/2008 Greiner
2009/0065373 A1 * 3/2009 Kornowski ..... A45C 11/16 206/6.1
2013/0256159 A1 10/2013 Walsh
2014/0263116 A1 * 9/2014 Wojciechowski .... A47F 5/0807 211/85.2

* cited by examiner

JEWELRY STORAGE AND DISPLAY APPARATUS

CROSS-REFERENCE TO RELATED APPLICATIONS

This application claims the benefit of U.S. Provisional Application No. 62/020,353, filed Jul. 2, 2014, which is hereby incorporated by reference.

BACKGROUND

Aspects of the present disclosure relate to storage and display apparatuses and in particular to storage and display apparatuses adapted beneficially to varied types of jewelry.

The storage of items of jewelry while not in use has presented challenges in respect of organization and appearance. Items of jewelry such as necklaces, earrings, bracelets, and rings have varied storage requirements and have traditionally been stored in separate compartments of horizontally disposed jewelry boxes. Such jewelry boxes often fail to maintain the articles in discrete accessible condition and also, when closed, hide the jewelry from view.

Needs exist for improved and/or alternative apparatuses beneficially adapted to store and gracefully display varied types of jewelry. The present disclosure, in several aspects, is addressed to these needs.

SUMMARY

In one aspect, the present disclosure relates to a jewelry storage and display apparatus. The apparatus includes an assembly of a plurality of display modules, where the display modules are connected to one another. The apparatus includes a first display module for supporting necklaces, the first display module including a first module wall supporting a plurality of first module hooks for hanging necklaces. The apparatus also includes a second display module for supporting necklaces and earrings, the second display module including a cabinet having a back wall and at least a first front door configured to close over at least a portion of the cabinet. The second display module can include a plurality of support fixtures mounted on the back wall for supporting necklaces, and the first front door can defines a plurality of openings adapted to receive and support earring portions (e.g. posts or backings) for hanging the earrings from the door. In certain embodiments, the first front door includes a perforate sheet defining a plurality of thru-holes providing such openings. The apparatus also includes a third display module for supporting bracelets, the third display module having a third module wall and at least one bar fixture for receiving thereover a plurality of bracelets. The apparatus also includes a fourth display module for supporting rings, the fourth display module including a fourth module wall supporting at least one mount fixture, and at least one ring storage pendant connected to, and preferably removably hung from, the mount fixture, the ring storage pendant adapted to receive thereover a plurality of rings.

In another aspect, the present disclosure relates to a jewelry storage and display apparatus that includes a cabinet having a back wall and at least a first front door configured to close over at least a portion of the cabinet. The apparatus further includes a plurality of support fixtures mounted on the back wall for supporting jewelry articles, and the first front door defines a plurality of openings adapted to receive earring portions (e.g. posts or backings) for hanging earrings from the door. The first front door can include a perforate sheet defining a plurality of openings adapted to receive the earring portions and/or a mesh material defining openings adapted to receive the earring portions.

In another aspect, the present disclosure relates to an apparatus for supporting jewelry rings, including a support wall supporting at least one and preferably a plurality of mount fixtures. The apparatus also includes at least one and preferably a plurality of ring storage pendants. The ring storage pendant(s) are connected to, and preferably removably suspended or hung from, the mount fixture(s), and the ring storage pendant(s) is/are sized and configured to receive thereover a plurality of jewelry rings in a stacked condition.

Additional embodiments as well as features and advantages thereof will be apparent to those of ordinary skill in the art from the descriptions herein.

DETAILED DESCRIPTION

Figure 1:
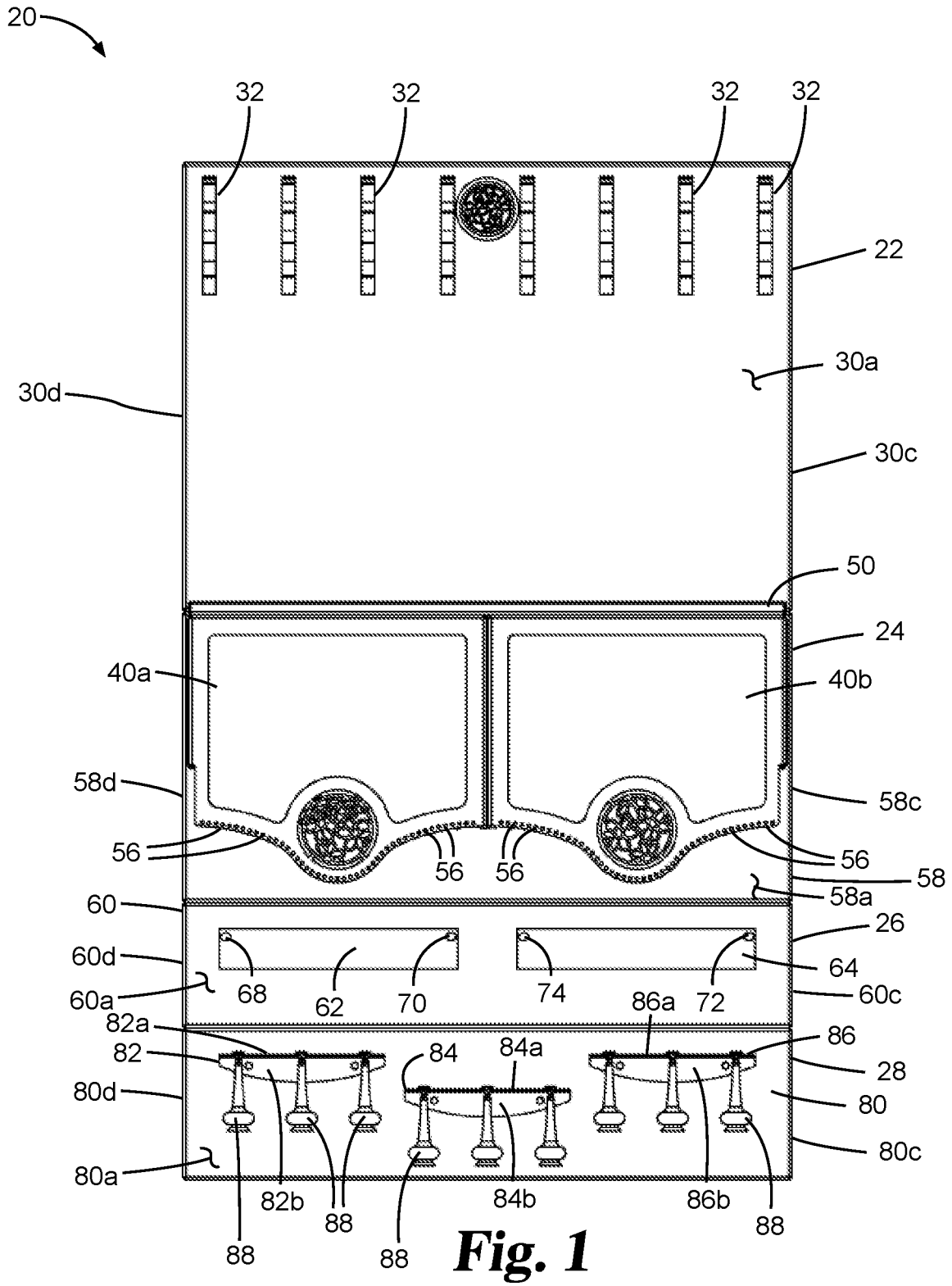
FIG. 1 is a front elevational view of one embodiment of a jewelry storage and display apparatus.
Figure 2:
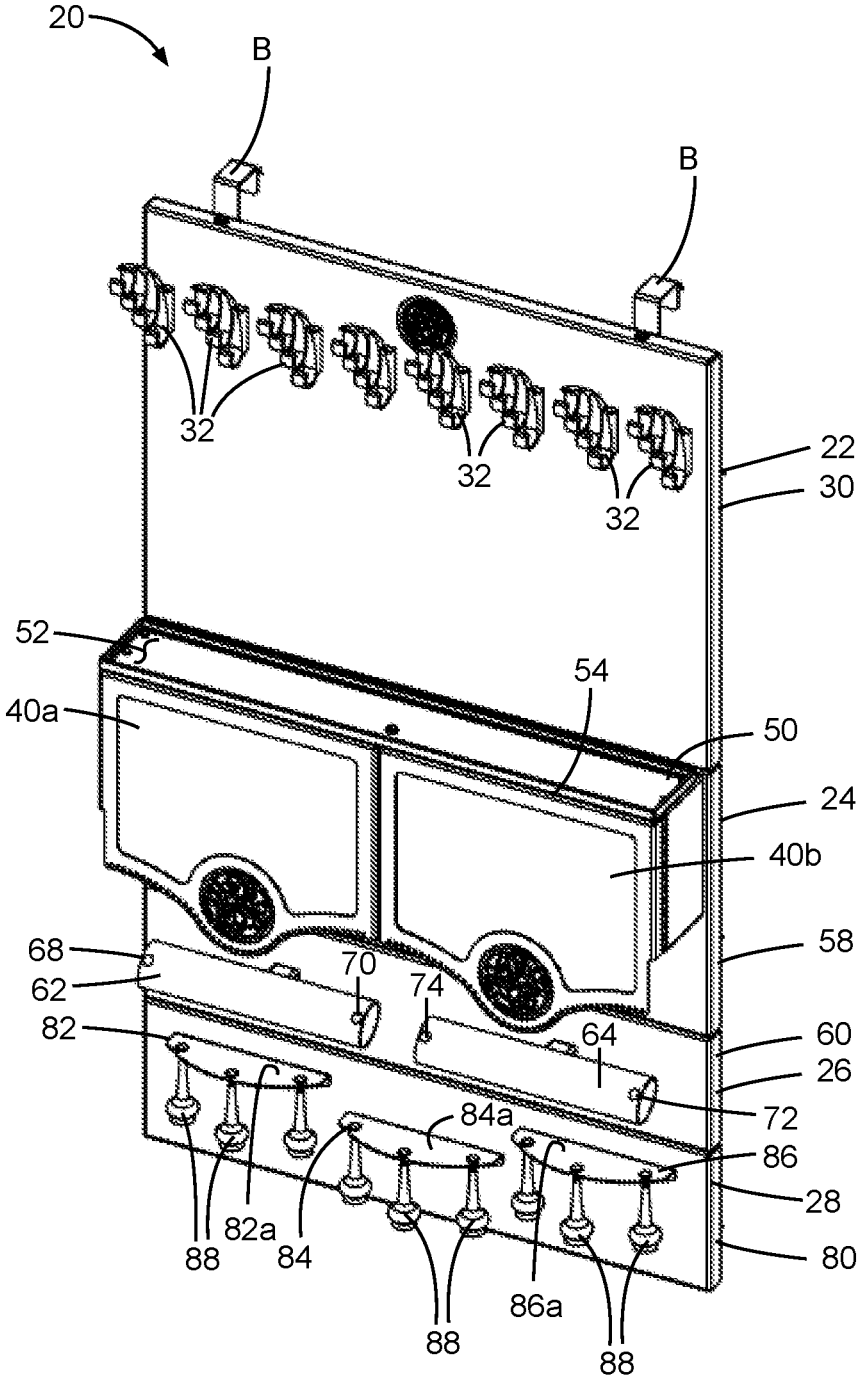
FIG. 2 is a perspective view of the apparatus of FIG. 1 from above.

For the purposes of promoting an understanding of the principles of the invention, reference will now be made to certain embodiments, including those illustrated in the drawings, and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention pertains. As well, provided below in this Detailed Description are numerous features of a jewelry storage and display apparatus and modules therefor; each such described feature, alone or combined with other ones of the described features, is contemplated herein as being combinable with the features described above in the Summary and with the features described below in the Listing of Certain Embodiments, to provide additional disclosed embodiments herein.

As disclosed above, aspects of the present disclosure relate to jewelry storage and display apparatuses. The apparatuses can be modular and designed to be situated with rear panels of the modules in a vertically-extending orientation, such as a hanging orientation. The modules can connect to one another, desirably such that an uppermost module, when connected to a support structure such as a wall or door, is capable of supporting the weight of connected modules located below.

With reference now to FIGS. 1-10, one illustrative embodiment herein is shown as jewelry storage and display apparatus 20. Apparatus 20 includes a first module 22, a second module 24, a third module 26, and a fourth module 28. First module 22 is an uppermost module, and can be supported by a support structure such as a wall or door of a building. Any suitable support mechanism can be used, including for example the use of hanging brackets attached to the first module 22 (see e.g. brackets "B" in FIG. 2) and/or the use of connectors such as nails, screws, bolts or the like that connect the module 22 to the support structure so that the module can hang from the support structure. It is contemplated also that the apparatus 20 can be freestanding in other embodiments, for example including a stand structure attached to one, some or all of the modules 22,24,26,28 that can rest on a horizontal surface such as a floor and support the modules in an upstanding condition.

In the illustrated embodiment 20, the first module 22 includes an upstanding (e.g. vertical) module wall 30 having a front surface 30*a*, a back surface 30*b*, a first side surface 30*c*, and a second side surface 30*d*. A plurality of hangers 32 each having one or more hooks, desirably multiple hooks, are connected to and supported by module wall 30. The hook(s) of hangers 32 in preferred forms are configured to support necklaces, particularly larger necklaces, looped over the hook(s). While hangers 32 in the illustrated embodiment are shown as discrete elements, they could also be provided as a unitary piece attached to module wall 30 if desired. In preferred forms each hanger 32 includes an arm 36 extending outward and away from the front surface 30*a* of module wall 30, with the arm 36 supporting a plurality of hooks 38 depending downwardly therefrom and being spaced from one another in a direction extending away from module wall 30. In this manner necklaces hung on hooks 38 of a given multi-hook hanger 32 will be layered horizontally for storage. As well, where as illustrated the hooks of a multi-hook hanger are vertically spaced from one another, the necklaces hung on the hooks 38 will be layered both horizontally and vertically relative to one another. In the illustrated embodiment the hooks 38 define forward-facing openings through which a segment of a necklace can be passed to loop the necklace, while remaining in a closed-loop condition, over the hooks 38 during movement of the necklace from the front of and toward the module wall 30; however, in other embodiments the hooks can include rearward-facing openings through which a segment of the necklace can be passed to loop the necklace, while remaining in a closed-loop condition, over the hooks during movement of the necklace outward and away from front surface 30*a* of module wall 30 from a position between the hook and the module wall. In still other embodiments, the hooks can be closable loops or clasps, and can be closed around the necklace while it remains in the closed-loop condition; or, the hooks can be closed loops and the necklace can be opened to a linear (not closed-looped) condition, threaded through the loop hook, and re-closed to suspend the necklace from the loop hook. These and other variations for the hooks will be apparent to those of ordinary skill in the art from the descriptions herein.

The second module 24 includes an upstanding (e.g. vertical) module wall 58 that is connected to and preferably suspended from first module 22. Module wall 58 includes a front surface 58*a*, a rear surface 58*b*, and lateral side surfaces 58*c* and 58*d*. The second module 24 has at least one front door that together with at least module wall 58 forms a cabinet structure. As illustrated, preferably the module 22 includes a first front door 40*a* and a second front door 40*b*, although more than two doors could also be included. Doors 40*a* and 40*b* are hingedly connected to door brackets 42 and 44, respectively, which can also provide partial or complete sidewalls to the cabinet structure depending on design. The brackets 42 and 44 are in turn connected to module wall 58. Doors 40*a* and 40*b* are suspended in a spaced condition from the front surface 58*a* of module wall 58 and can be opened in a swinging motion outwardly from front surface 58*a*.

Figure 3:
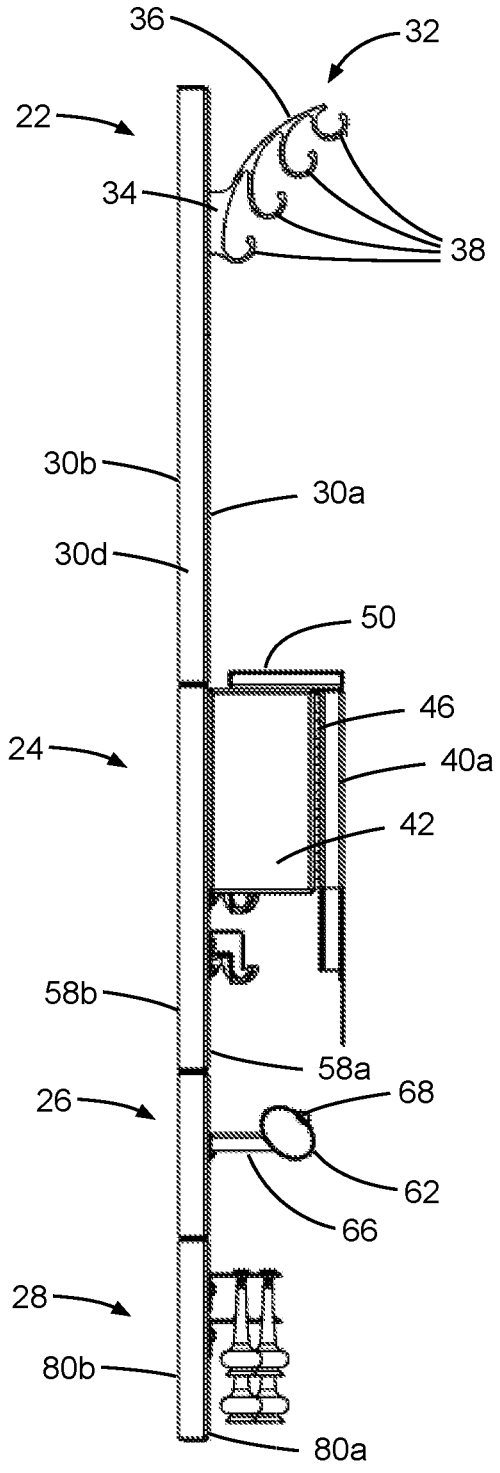
FIG. 3 is a left side elevational view of the apparatus of FIG. 1.
Figure 4:
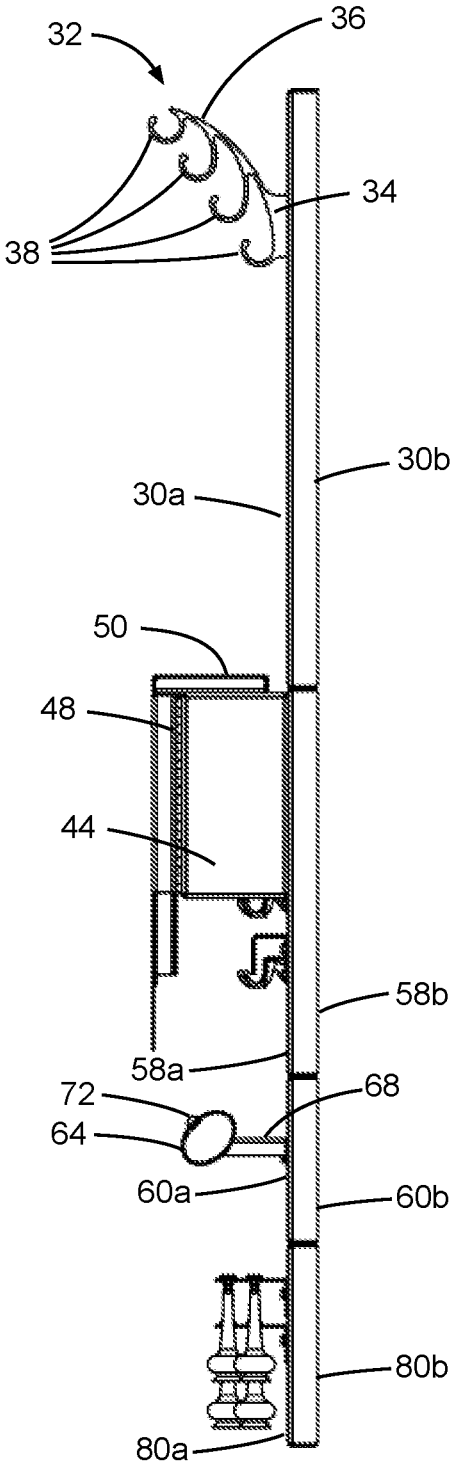
FIG. 4 is a right side elevational view of the apparatus of FIG. 1.
Figure 5:
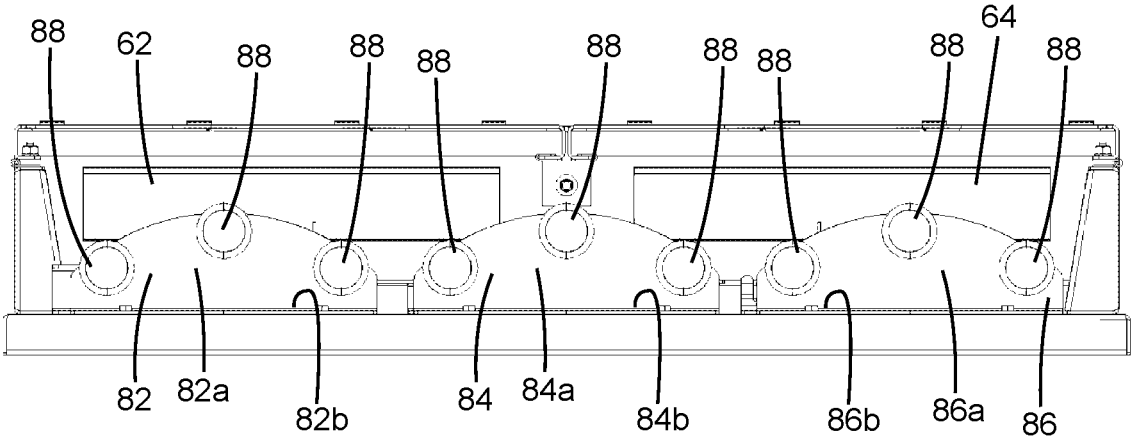
FIG. 5 is a bottom view of the apparatus of FIG. 1.
Figure 6:
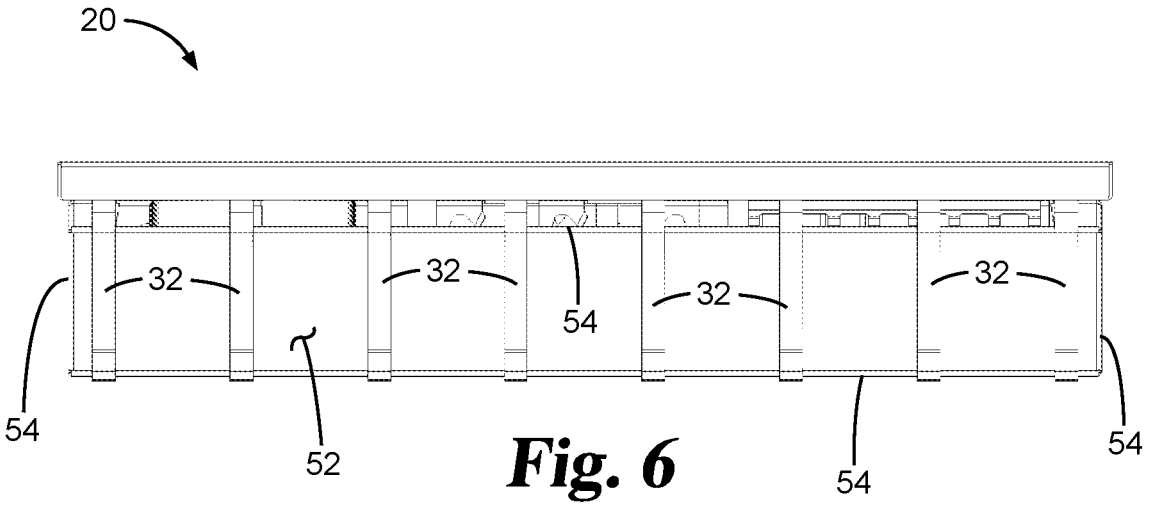
FIG. 6 is a top view of the apparatus of FIG. 1.
Figure 7:
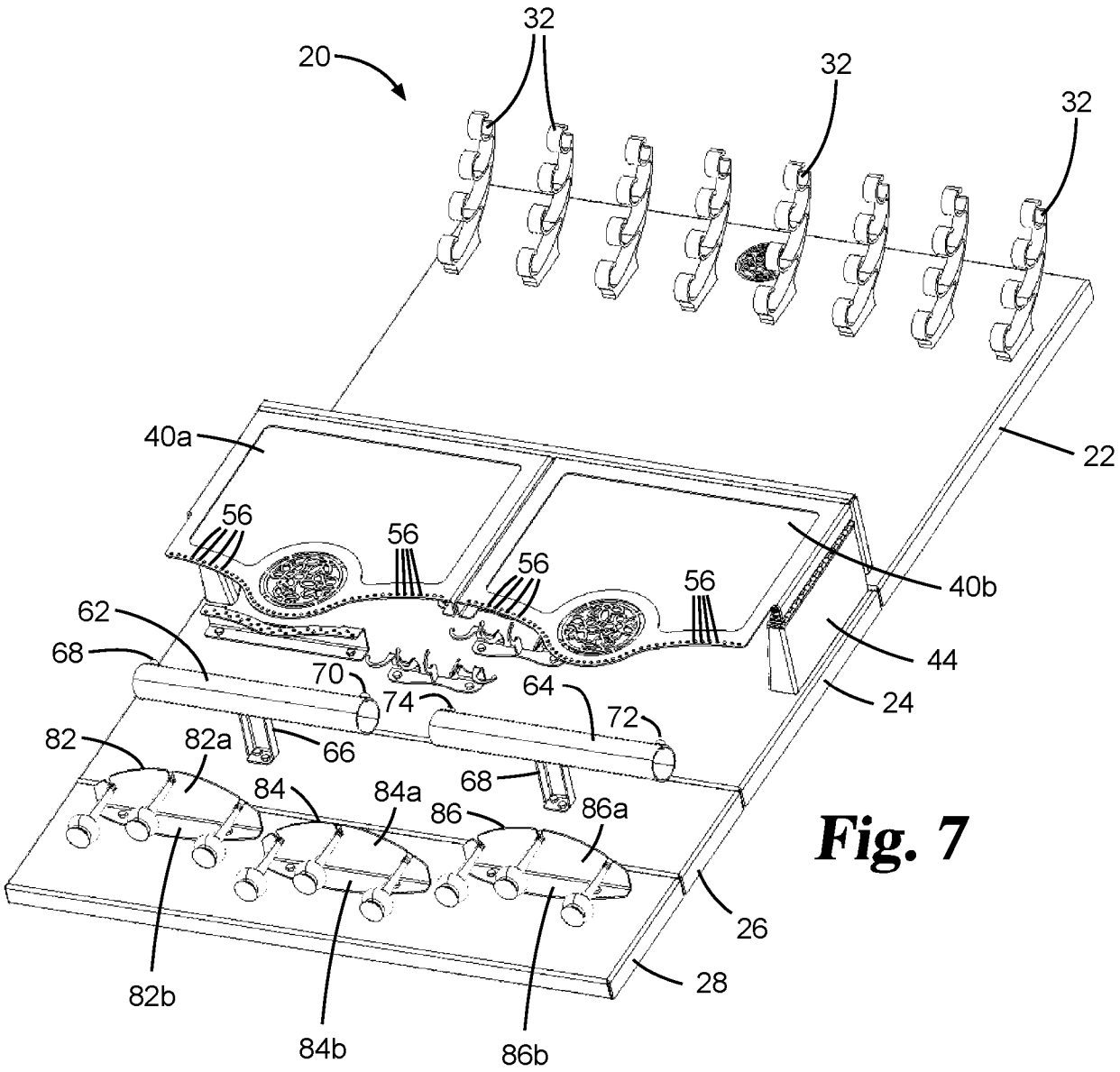
FIG. 7 is a perspective view of the apparatus of FIG. 1 from below.

Second module 24 also includes an upper tray 50 positioned above doors 40*a* and 40*b*, for example supported in part or wholly by brackets 42 and 44. Tray 50 can for example be supported by and potentially connected to the upper surface of brackets 42 and 44 (see e.g. FIG. 8). Tray 50 includes an upwardly facing exposed surface 52 and an upwardly raised lip 54 traversing a periphery of the surface 52. Tray 50 can be used to support and display items of jewelry such as rings, broaches, or others. Tray 50 and in particular its upper surface 52 also works in synergy with hooks 38 of first module 22 and in particular in situations in which necklaces or other flexible looped items are hung from hooks 38 and are sufficiently long to contact upper surface 52. In this way, lower portions of such long necklaces can be supported by upper surface 52 instead of hanging further downward in the apparatus 20 and potentially becoming tangled with other items or creating a less pleasing appearance. As well, the support of lower portions of such long necklaces on surface 52 serves to stabilize the position of the suspended portions of those necklaces, decreasing or preventing swinging or twisting movements that might otherwise occur and potentially frustrate ready access to and removal of the items for use. On the other hand, as best seen in FIGS. 3, 4 and 6, in the preferred form the rearward edge of tray 50 is spaced from the front surface 58*a* of module wall 58, leaving a clearance into which the lower portions of necklaces hung on hangers (and in particular on the hooks 38 closest to front surface 58*a*) can be extended by a user if desired.

Doors 40*a* and 40*b* also preferably include a plurality of thru-holes 56 in panel portions of the doors and in especially preferred embodiments in close proximity (e.g. within about 3 cm, or within about 2 cm, or within about 1 cm) to a free edge, preferably a bottom free edge, of the panel portions. Through holes 56 can receive the studs or backings of a variety of types earrings (e.g. fish hook wires, friction backs, latch backs, lever backs or French backs) to be suspended from doors 40*a* and 40*b*, and when in close proximity to a free edge of a door panel portion as discussed above can provide beneficial hanging and removal access to a wider variety of earring styles. For example, some earrings have a curved loop or hoop shape that would not effectively or attractively thread through and be supported by holes 56 if those holes were centrally located in a door panel portion as opposed to being in close proximity to a free edge as discussed above. With the holes 56 in close proximity to the free edge, a clearance is provided beyond the free edge both for a rotating threading action to thread the curved loop or hoop earring portion through the hole. As well, downwardly-depending portions of the hole-supported earrings can be suspended within that clearance beyond the panel portion free edge, especially where the free edge is a bottom free edge of a panel portion. The curved and especially multi-directional curved bottom free edge of the doors 40*a* and 40*b* provides additional length along which thru-holes can be located to improve the storage capacity of second module 24.

Third module 26 has an upstanding (e.g. vertical) module wall 60 that is connected to and preferably suspended from module wall 58 of second module 24. Module wall 60 has front and rear surfaces 60*a* and 60*b* respectively and lateral side surfaces 60*c* and 60*d*. Third module 26 is adapted for bracelet storage and includes at least one storage and display bar for receiving and supporting bracelets or other similar partial loop items of jewelry, and preferably two or more such storage and display bars. In preferred forms the storage bar(s) are mounted with their long axis extending in a non-vertical (e.g. substantially horizontal) direction and/or define a curved outer surface over which the partial loop of the bracelet(s) or similar items can be received, e.g. by slipping the item(s) onto the bar(s) from the side and/or by resilient flexion or a hinged motion of the item(s) that temporarily enlarges the opening of their loop to allow them to be advanced onto the bar(s) from the front. The storage bar(s) can be generally straight or can be curved. In the illustrated embodiment two storage and display bars 62 and 64 are provided. Bars 62 and 64 and/or other bar(s) of third module 26 can be provided by cylinders as illustrated and provided as such or otherwise the bar(s) are preferably generally ovate in cross section, although other cross sectional shapes such as circles and/or polygons can be used in other embodiments. When ovate or other cross-sectional shapes are used that have a first axis that is longer than a second axis, as illustrated for bars 62 and 64, the longer first axis is desirably positioned at an acute (less than 90 degrees) angle relative to the front surface 58*a* of module wall 58 with the longer first axis extending away from front surface 58*a* when considered in a direction from upward to downward.

Storage and display bar 62 also defines a first stop member 68 and a second stop member 70 extending outward from adjacent surfaces of the bar 62, and bar 64 similarly includes third stop member 72 and fourth stop member 74 extending outward from adjacent surfaces of the bar 64. These stop members 68,70,72,74 are constructed and arranged to frictionally impede lateral sliding of bracelet(s) or other similar partial loop items of jewelry to resist their sliding off of ends of bars 62 and 64. For these purposes it is desirable to have at least two stop members per bar and to position a first of them proximate to a first end of the bar and a second of them proximate to a second end of the bar. It will also be understood that more than two stop members could be provided along the length of the bar, for example to segment the bar into multiple storage areas occurring between the stop members, with each storage area designed to receive one or more bracelets or similar partial loop items. In the illustrated embodiment stop members 68,70,72,74 are provided by outwardly projecting structures attached to the bars 62 and 64 and generally defining spherical segments, for example provided by rivets attached to bars 62 and 64 and having rounded heads serving as stop members; however, it will be understood that other stop member structures could also be used, including for example lips, nibs or other structures projecting from adjacent surfaces of the bars.

Storage and display apparatus 20 also includes a fourth module 28. Fourth module has an upstanding (e.g. vertical) module wall 80 connected to and preferably suspended from module wall 60 of third module 26. Module wall 80 has front and back surfaces 80*a* and 80*b* and first and second lateral surfaces 80*c* and 80*d*. Module 28 is constructed and arranged for beneficial storage of jewelry rings or other similar partially or completely closed loop jewelry items. For these purposes module 28 includes mount fixtures 82, 84 and 86 mounted to wall 80 at spaced positions from one another. Fixtures 82,84,86 each include a respective outwardly extending wall 82*a*,84*a*,86*a* extending transverse (preferably generally perpendicular to) front surface 80*a* of module wall 80, and a respective mount wall 82*b*,84*b*,86*b* connected to module wall and preferably extending generally parallel to front surface 80*a*. Module 28 also includes a plurality of storage pendants 88 removably supported by and suspended from outwardly extending walls 82*a*,84*a*,86*a*. For these purposes, in the illustrated embodiment, outwardly extending walls 82*a*,84*a*,86*a* each define a plurality of slots (see e.g. FIG. 10 providing an enlarged view of fixture 82, to which fixtures 84 and 86 can be identical) into which a narrower portion of each pendant 88 is positioned, with each pendant 88 also having a broader portion occurring above the narrower portion and dimensioned so as to be impassible through the slot so that it has portions that rest against the corresponding outwardly extending wall (82*a*, 84*a* or 86*a*) so that the pendant 88 is supported by and suspended from the corresponding outwardly extending wall. Additional and more detailed discussions of the illustrated embodiments of the fixtures and pendants are provided below.

While in the illustrated embodiment the pendants 88 are removably supported in slots of the fixtures, other ways to support (preferably removably support) and suspend the pendants are also contemplated within embodiments herein. These may include for example other arrangements in which a structure of a pendant overlaps a structure of a fixture (e.g. a tongue in groove arrangement where the tongue can occur on the pendant and the groove on the fixture, or vice versa), magnetic force (e.g. where one of the pendant or the fixture is made of or includes a magnetic material and the other is made of or includes a ferrous metal, or where both are made of or include a magnetic material), a detent clip or other clip arrangement, or any other suitable structure or mechanism for suspending the pendant from the fixture, preferably removably. Also, while in the illustrated embodiment each fixture supports and suspends multiple pendants, in other forms each pendant can be supported from its own fixture. These and other variations will be apparent to those skilled in the pertinent art from the descriptions herein.

Figure 9:
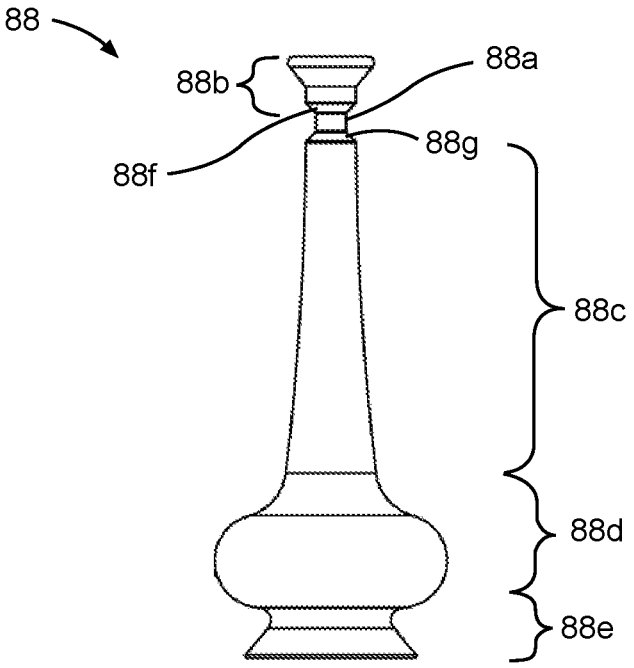
FIG. 9 is a front elevational view of a storage pendant of the apparatus of FIG. 1.
Figure 10:
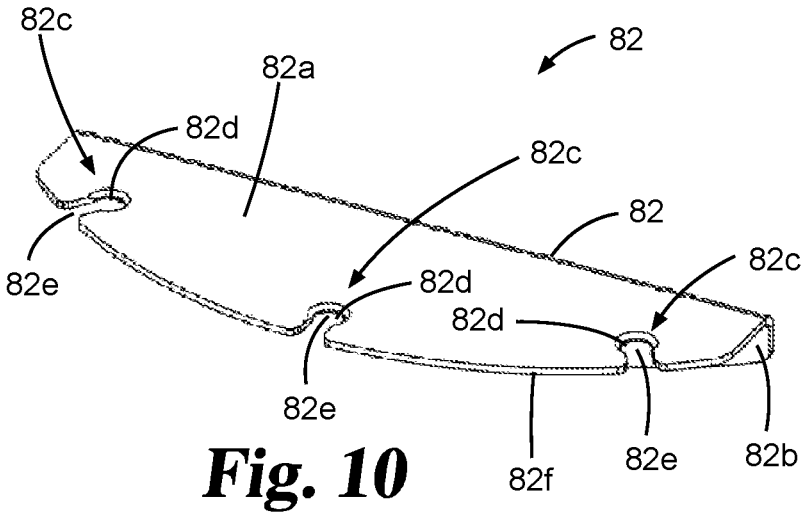
FIG. 10 is a perspective view of a hanging bracket for the storage pendant of FIG. 9.

With reference especially to FIGS. 9 and 10, the illustrated fixture/pendant arrangement will now be more particularly described. Pendant 88 (FIG. 9) includes a narrower portion 88*a* defining a first maximum cross-sectional dimension, and an adjacent and upper broader portion 88*b* having a second maximum cross-sectional dimension that is larger than the first maximum cross-sectional dimension. The second maximum cross-sectional dimension is, however, smaller than the internal opening of the jewelry items (e.g. rings) intended for storage on the pendant 88, so that upper broader portion 88*b* can be passed through such internal openings. Pendant 88 also includes an elongate storage segment 88*c* occurring adjacent to and below narrower portion 88*a*. Storage segment 88*c* has a third maximum cross-sectional dimension that is smaller than the internal opening of the jewelry items intended for storage on pendant 88. Pedant 88 also includes an abutting segment 88*d* occurring adjacent to and below storage segment 88*c*. Abutting segment 88*d* has a maximum cross-sectional dimension that is larger than the internal opening of the jewelry items intended for storage on pendant 88, so that when those jewelry items are slidably positioned on and around pendant 88 and forced (e.g. by gravity) in a direction away from upper segment 88*b*, they abut segment 88*d* and are prevented from sliding off of pendant 88. Pendant 88 can also include a lower segment 88*e* adjacent to and below abutting segment 88*d*, which can for example serve as a stand for supporting pendant 88 on a horizontal surface by positioning the lower surface of segment 88*e* against that horizontal surface.

With reference now to FIGS. 9 and 10 together, the cooperation between the pendants 88 and mount fixtures 82,84,86 will now be more particularly described. While FIG. 10 is labeled as a illustration of fixture 82, it will be understood that in the preferred illustrated embodiment fixtures 84 and 86 are similarly constructed. Fixture 82 has outwardly extending wall 82*a* and mount wall 82*b*, preferably formed as a single piece. Wall 82*a* defines a plurality of slots 82*c*. Each slot 82*c* has an internal region 82*d* and a peripheral region 82*e*. Peripheral region 82*e* is positioned proximate to the outermost peripheral edge 82*f* of wall 82*a*, and internal region 82*d* is positioned inward of peripheral edge 82*f* relative to peripheral region 82*e*. Internal region 82*d* has a largest cross-sectional diameter that is greater than the largest cross-sectional diameter of peripheral region 82*e*. The largest cross-sectional dimensions of both region 82*d* and 82*e* are smaller than the largest cross-sectional dimension of upper broader portion 88*b* of pendant 88 and larger than the largest cross-sectional dimension of narrower portion 88*a* of pendant 88. In this manner, narrower portion 88*a* of pendant 88 can be slid into slot 82*c*, and pendant can be suspended (e.g. under the force of gravity) from wall 82*a* of fixture 82 with portions of the upper broader portion 88*b* of pendant 88 resting against an upper surface of wall 82*a*. As discussed above, slot region 82*d* has a largest cross-sectional dimension that is larger than that of slot region 82*e*. This allows a more beneficial supportive and position-stable cooperation between the slot 82*c* and the pendant 88. In particular, the upper broader portion 88*b* of pendant 88 defines a downwardly-facing conical surface 88*f*, with the cross-sectional dimension of the conical surface decreasing in the downward direction (and thus increasing in the upward direction). When the conical surface 88*f* is positioned over the peripheral region 82*e* of slot 82*c*, and subjected to downward force (e.g. gravity), the conical surface 88*f* abuts the wall 82*a* of fixture 82 with the pendant 88 positioned at a first height. When the pendant 88 is slid further into slot 88*c* to position the conical surface 88*f* over the internal region 82*d* of slot 82*c* (e.g. with the internal region shaped as a generally circular opening to cooperatively mate with conical surface 88*f*), and subjected to downward force (e.g. gravity), the conical surface travels downwardly from its position at the above-noted first height and abuts the wall 82*a* of the fixture 82 with the pendant 88 positioned in its storage position at a second height lower than the first height. In this fashion, to remove pendant 88 from slot 82*c* by sliding it back out of slot 82*c*, a user must first force the pendant upward to at least the first height, and then slide the pendant out of slot 82*c*. This arrangement stabilizes the pendant 88 against accidental movement along (and potentially out of) slot 82*c* when in its storage position received within slot region 82*d*.

As well, as illustrated in FIG. 9, the storage segment 88*c* of pendant 88 can define an upwardly-facing conical surface 88*g*, with the cross-sectional dimension of the conical surface 88*g* increasing in the downward direction (and thus decreasing in the upward direction). This surface 88*g* can control upward movement of pendant 88 while positioned in slot 88*c* in a similar but opposite fashion to control of downward movement of the pendant 88 by surface 88*f*, discussed above. Thus, when the conical surface 88*g* is positioned under the internal region 82*d* of slot 82*c*, and subjected to upward force (e.g. by a user), the conical surface 88*g* abuts the wall 82*a* of fixture 82 with the pendant 88 positioned at a third height. When the pendant 88 is positioned further outward in slot 88*c* with the conical surface 88*g* under the peripheral region 82*e*, when subjected to upward force (e.g. by a user), the conical surface 88*g* abuts the wall 82*a* of the fixture 82 with the pendant 88 at a fourth height lower than the third height. In this fashion, during removal of pendant 88 from slot 82*c*, downwardly-facing surface 82*g* provides a functional limit to the upward travel of pendant 88.

While in the illustrated embodiment the downwardly facing surface 88*f* is a conical surface, it will be understood that other surfaces that decrease in cross-sectional dimension in the downward direction can be used within embodiments herein, including for example wedge, pyramidal, tetrahedral, spheroidal, or ellipsoidal shapes, or segments or truncated portions thereof. Similarly, it will be understood that other such surfaces that increase in cross-sectional dimension in the downward direction, including for example those shapes specifically listed above, can be used in place of a conical surface for surface 82*g*.

Figure 8:
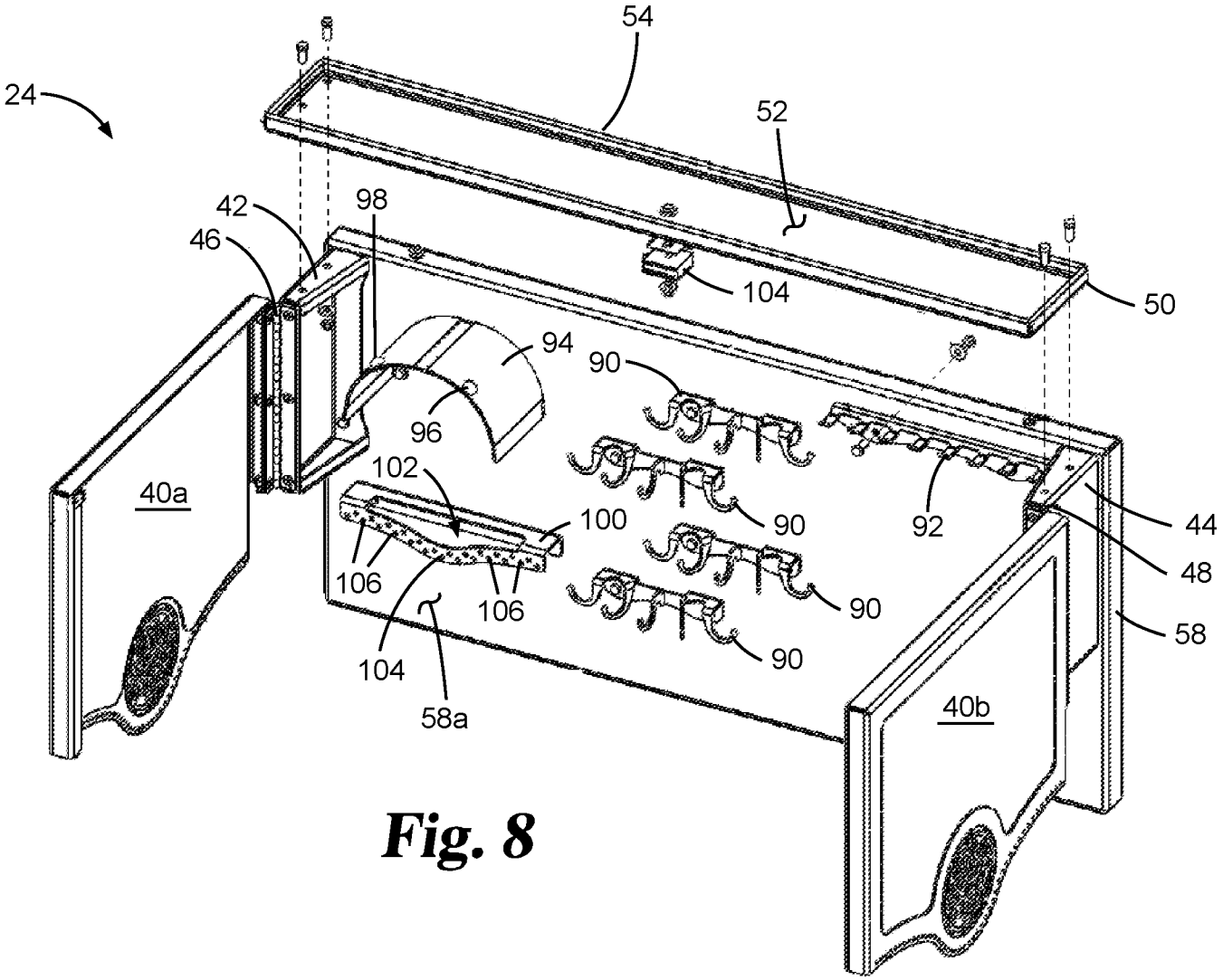
FIG. 8 is a partially exploded perspective view of one module of the apparatus of FIG. 1.

Reference will now be made to FIG. 8 to describe various preferred features of the second module 24 of storage and display apparatus 20. FIG. 8 provides a partially exploded perspective view of module 24 with doors 40*a* and 40*b* in an open position, illustrating preferred features occurring behind doors 40*a* and 40*b* when in a closed position. Shown is module wall 58 to which door brackets 42 and 44 are connected. Door 40*a* is hingedly connected to bracket 42 by hinge 46 and door 40*b* is hingedly connected to bracket 44 by hinge 48. Tray 50 is connected to brackets 42 and 44 by bolts or other similar connectors (connection paths shown in dotted lines) and supported thereby.

Module 24 also includes a plurality of jewelry support members mounted to module wall 58 and positioned to reside behind doors 40*a* and 40*b* when in a closed position. In the illustrated embodiment a plurality of multi-hook units 90, each defining a plurality of hooks, are mounted to module wall 58. In preferred forms as illustrated the hooks of each unit 90 include hooks extending at differing angles relative to the front surface 58*a* of module wall 58. For example as illustrated, first, outer hook(s) of a given unit 90 can extend generally parallel to front surface 58*a*, second hook(s) immediately adjacent thereto can extend transverse to the front surface 58*a* preferably with its/their wall 58-facing surface(s) defining a first acute angle relative to the front surface 58*a*, and optionally also third hook(s) can be provided immediately adjacent to the second hook(s) and can extend perpendicular to the front surface, or transverse to the front surface 58*a* with its/their wall 58-facing surface(s) defining a second angle greater than the first acute angle. Hook units 90 are preferably beneficially adapted to support and store jewelry items such as necklace pendants, lockets or slides in a hanging condition.

Also mounted to module wall 58 of second module 24 is a multi-prong unit 92. Unit 92 includes a plurality of outwardly extending prongs adapted for hanging necklace chains (e.g. onto which a user can thread selected pendants or lockets retrieved from multi-hook units 90) or other similar flexible linear or looped items of jewelry. In the illustrated embodiment each prong of unit 92 is provided by a generally flat wall having a straight portion extending away from module wall 58, e.g. perpendicular to front surface 58*a* of module wall 58, and an upturned segment adjacent to and outward from the generally straight segment. Unit 92 is mounted to module wall 58 to provide the prongs in an upper portion thereof, e.g. in the uppermost 20% of the height of module wall 58, to allow space below to hang chains or other similar items. Other locations can however be used in other embodiments. As well, in the illustrated unit 92 the prongs are positioned in a generally co-planar relationship with one another. It will be understood, however, that other prong orientations relative to one another, and shapes, are contemplated.

A necklace arch member 94 is also mounted to module wall 58. Necklace arch member 94 defines a convexly curved upper surface, for supporting necklaces thereon, particularly necklaces that are of a construction whereby they are self-retained in an arched or curved shape (e.g. stiff rope, choker, collar or omega style necklaces). Necklace arch member 94 can also include one or more stop members extending outward from adjacent portions of the upper surface of member 94, and in the illustrated embodiment includes two such stop members 96 and 98. These stop members are constructed and arranged to frictionally impede outward (away from wall 58) sliding of necklaces or other similar loop items of jewelry to resist their sliding off of the outer edges of member 94. For these purposes it is desirable to position the stop member(s) proximate to the outermost edge of member 94 as illustrated. It will also be understood that more than two stop members could be provided along the member 94. In the illustrated embodiment stop members 96 and 98 are provided by outwardly projecting structures attached to the upper surface of member and generally defining spherical segments, for example provided by rivets attached to member 94 and having rounded heads serving as stop members; however, it will be understood that other stop member structures could also be used, including for example lips, nibs or other structures projecting from adjacent portions of the upper surface of member 94. Also, while in the depicted embodiment the arch member 94 is provided by a curved wall circumscribing an angle of less than 360 degrees, other structures providing a curved or arched upper surface could also be used including solid pieces, a completely closed loop formed by a curved wall, and others.

Also mounted to module wall 58 of second module 24 is a storage support fixture 100. Support fixture 100 includes a frame extending away from wall 58 and defining an opening 102. Positioned outward of opening 102 is storage arm 104 defining a plurality of apertures 106. Apertures 106 are beneficially adapted for receiving the backings of pierced style earrings to suspend, store and display the earrings on support 100. The rearward portions of such earring backings occurring behind storage arm 104 during storage will thereby be received within the clearance provided by opening 102. While support fixture 100 as shown provides storage arm 104 with apertures spaced from module wall 58 and having a clearance therebehind, other structures providing these features can also be used in embodiments herein.

Figure 11:
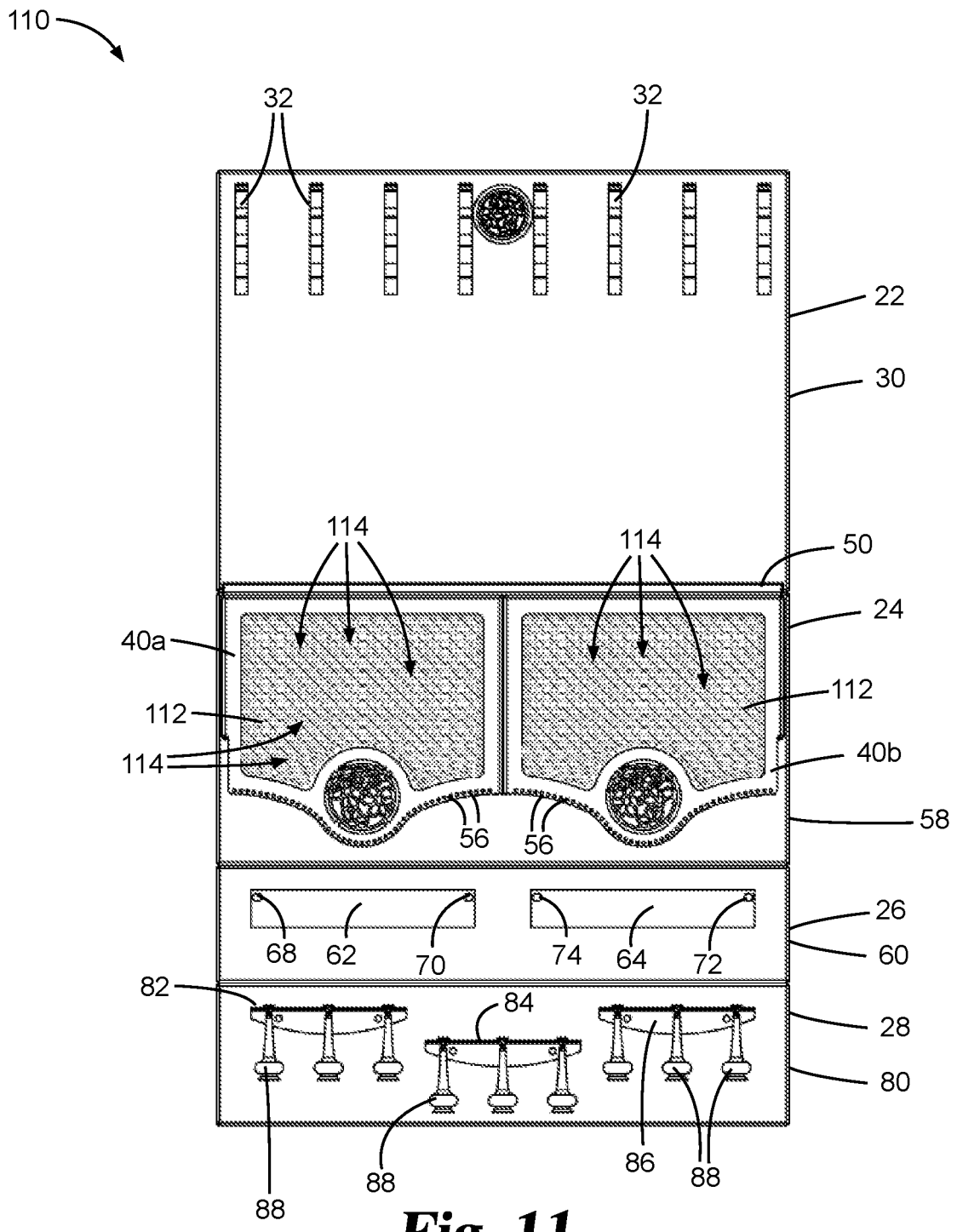
FIG. 11 is a front elevational view of another embodiment of a jewelry storage and display apparatus similar to the embodiment of FIG. 1 except having mesh door panel portions.

With reference now to FIG. 11, shown is another embodiment of a jewelry storage and display apparatus herein. Apparatus 110 is the same as apparatus 20 and has parts similarly numbered, except apparatus 110 has mesh door panel portions 112. Mesh door panel portions define openings 114 between wires or straps of the mesh. These openings 114 can be used to receive the backings of earrings (e.g. pierced earrings such as friction-backs or fish hook wires) or the support structures on other jewelry items, so that those earrings or other items can be supported on the mesh and displayed on the front of the mesh panel portions 112. In this fashion, the mesh panel portions provide a highly adaptable continuous surface area on which a user can select, arrange and space jewelry items to create an appealing display appearance. Woven mesh materials, including metallic materials such as stainless steel, are preferred for panels 112.

The elements of the apparatuses disclosed herein can be made from any suitable material or combinations of material, including as examples metal, plastic, wood, ceramic and/or other materials. All connections or attachments can be made using any of a variety of known methods or mechanism including connectors such as screws, bolts, nails or rivets and/or bonding such as by glues, welding or other techniques. The skilled person will likewise recognize that combinations of elements disclosed herein can be made as unitary pieces by fabrication methods such as machining and/or stamping and/or by molding or other known techniques. Surface finishing techniques can also be used to contribute to the appearance or performance of the elements of the apparatuses herein, including for example polishing, painting (e.g. by powder coating) or other techniques.

As disclosed above, in certain embodiments herein two, three or four modules as disclosed herein can be combined to provide an overall apparatus. For these purposes the modules can be connected to one another, for example, by connectors such as bolts/nuts that connect the module walls of the various modules. As an example, the separate module walls can have rearward-facing lips that can be abutted to one another and bolts can be passed through the abutted lips and secured with nuts to connect the modules to one another. Other connecting arrangements could also be used to connect the module walls to one another, including for example tongue-in-groove arrangements between the separate module walls, or cooperating clips or clamps on the module walls that can be used to secure them to one another. These and other connecting arrangements can be used. In desired combined forms, the lower edge of one module wall will be abutting or in close proximity to the upper edge of another module positioned below, and these edges can be arranged generally parallel to one another in the combined arrangement.

Also, while discussions above describe an apparatus with the first, second, third and fourth modules combined, it is contemplated herein that each module also forms an independent embodiment herein. Such modules can for example be manufactured and sold separately, to allow users to either simply employ one of the modules, or to select which modules to obtain and potentially combine to form a combined apparatus as disclosed herein. As well, while discussions herein at some points focus on embodiments positioned in a vertical or otherwise upstanding position, the apparatuses disclosed herein could also be used in a horizontal position on a temporary or permanent basis if desired, and thus expressions herein such as "upward" or "downward" or variants thereof should be understood as disclosing a relative movement or positioning of elements with respect to one another as opposed to a requirement for vertical or horizontal movement with respect to the Earth's surface, unless context clearly dictates to the contrary.

Listing of Certain Embodiments

The following provides an enumerated listing of some of the embodiments disclosed herein. It will be understood that this is a non-limiting listing of embodiments, and that other embodiments are disclosed in the discussions hereinabove.

1. A jewelry storage and display apparatus, comprising:

an assembly of a plurality of display modules, said display modules connected to one another and including, a first display module for supporting necklaces, the first display module including a first module wall supporting a plurality of first module hooks for hanging necklaces;

a second display module for supporting necklaces and earrings, the second display module including a second module wall, the second display module providing a cabinet structure having a back wall and at least a first front door configured to close over at least a portion of the cabinet structure, the second display module including a plurality of support fixtures mounted on the second module wall for supporting necklaces, and wherein the first front door defines a plurality of openings adapted to receive and support earring portions;

a third display module for supporting bracelets, the third display module having a third module wall and at least one bar fixture for receiving thereover a plurality of bracelets; and a fourth display module for supporting rings, the fourth display module including a fourth module wall supporting at least one mount fixture, and a ring storage pendant connected to the mount fixture, the ring storage pendant adapted to receive thereover a plurality of rings.

2. The apparatus of embodiment 1, wherein the first front door has a door panel comprised at least in part of a perforate sheet having thru-holes providing said openings adapted to receive earring portions; preferably wherein the perforate sheet defines a lower perimeter region of the first door, and more preferably wherein the apparatus defines a clearance below the perforate sheet for receiving suspended earring portions.

3. The apparatus of any preceding embodiment, wherein at least some of the first module hooks are provided by at least one multi-hook hanger; preferably wherein the multi-hook hanger positions a series of hooks spaced from one another in a direction extending away from the first module wall.

4. The apparatus of any preceding embodiment, wherein the second display module also includes a second front door, the second front door; preferably wherein the second front door has a door panel comprised at least in part of a perforate sheet having thru-holes providing said openings adapted to receive earring portions; preferably wherein the perforate sheet defines a lower perimeter region of the second front door; and more preferably wherein the apparatus defines a clearance below the perforate sheet of the second front door for receiving suspended earring portions.

5. The apparatus of any preceding embodiment, wherein the bar fixture has an ovate cross-sectional shape.

6. The apparatus of any preceding embodiment, wherein the at least one mount fixture of the fourth display module includes a slot, and wherein the ring storage pendant includes a portion removably received in the slot.

7. A jewelry storage and display apparatus, comprising:

a cabinet having a back wall and at least a first front door configured to close over at least a portion of the cabinet;

a plurality of support fixtures mounted on the back wall for supporting jewelry articles; and the first front door defining a plurality of openings adapted to receive and support earring portions; preferably wherein the first front door has a door panel comprised at least in part by a wire mesh defining a plurality of said openings and/or at least in part by a perforate sheet defining a plurality said openings.

8. The apparatus of embodiment 7, wherein the perforate sheet defines a lower perimeter region of the first front door, and wherein the apparatus defines a clearance below the perforate sheet for receiving suspended earring portions.

9. An apparatus for supporting jewelry rings, comprising:

a support wall supporting at least one mount fixture;

at least one ring storage pendant connected to the at least one mount fixture.

10. The apparatus of embodiment 9 including a plurality of mount fixtures each supporting a plurality of ring storage pendants; preferably wherein each ring storage pendant is removably suspended from one of said mount fixtures and each ring storage pendant is sized and configured to receive thereover a plurality of rings in a stacked condition.

11. An apparatus according to any preceding embodiment, also including a plurality of items of jewelry supported on the apparatus.

12. A method for storing items of jewelry comprising supporting the items of jewelry on an apparatus of any preceding embodiment.

The uses of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, all references cited herein are indicative of the level of skill in the art and are hereby incorporated by reference in their entirety.

The invention claimed is:

1. A jewelry storage and display apparatus, comprising:

an assembly of a plurality of display modules, said display modules connected to one another and including, a first display module for supporting necklaces, the first display module including a first module wall supporting a plurality of first module hooks for hanging necklaces;

a second display module for supporting necklaces and earrings, the second display module including a second module wall, the second display module providing a cabinet structure having a back wall and at least a first front door configured to close over at least a portion of the cabinet structure, the second display module including a plurality of support fixtures mounted on the second module wall for supporting necklaces, and wherein the first front door defines a plurality of openings adapted to receive and support earring portions;

a third display module for supporting bracelets, the third display module having a third module wall and at least one bar fixture for receiving thereover a plurality of bracelets; and a fourth display module for supporting rings, the fourth display module including a fourth module wall supporting at least one mount fixture, and a ring storage pendant connected to and depending downwardly from the at least one mount fixture, the ring storage pendant adapted to receive thereover a plurality of rings; and wherein the at least one mount fixture of the fourth display module includes a slot, and wherein the ring storage pendant includes a portion removably received in the slot and a downwardly extending ring storage segment suspended below the at least one mount fixture.

2. The apparatus of claim 1, wherein the first front door has a door panel comprised at least in part of a perforate sheet having thru-holes providing the plurality of openings adapted to receive earring portions.

3. The apparatus of claim 2, wherein the perforate sheet defines a lower perimeter region of the first door.

4. The apparatus of claim 3, wherein the apparatus defines a clearance below the perforate sheet for receiving suspended earring portions.

5. The apparatus of claim 1, wherein at least some of the first module hooks are provided by at least one multi-hook hanger.

6. The apparatus of claim 5, wherein the multi-hook hanger positions a series of hooks spaced from one another in a direction extending away from the first module wall.

7. The apparatus of claim 1, wherein the second display module also includes a second front door.

8. The apparatus of claim 7, wherein the second front door has a door panel comprised at least in part of a perforate sheet having thru-holes providing the plurality of openings adapted to receive earring portions.

9. The apparatus of claim 8, wherein the perforate sheet defines a lower perimeter region of the second front door.

10. The apparatus of claim 9, wherein the apparatus defines a clearance below the perforate sheet of the second front door for receiving suspended earring portions.

11. The apparatus of claim 1, wherein the bar fixture has an ovate cross-sectional shape.

12. An apparatus according to claim 1, also including a plurality of items of jewelry supported on the apparatus.

13. A method for storing items of jewelry comprising placing the items of jewelry on the jewelry storage and display apparatus of claim 1.

14. An apparatus for supporting jewelry rings, comprising:

a support wall supporting at least one mount fixture;

at least one ring storage pendant connected to the at least one mount fixture by being removably suspended from the at least one mount fixture;

wherein the at least one ring storage pendent depends downwardly from the at least one mount fixture and includes an elongate storage segment positioned above an abutting segment, the abutting segment having a maximum cross-sectional dimension that is greater than that of the elongate storage segment so that a jewelry ring slidably positioned on and around the elongate storage segment is forced by gravity to abut the abutting segment and thereby prevented from sliding off of the ring storage pendant; and wherein the at least one mount fixture has a fixture wall extending outwardly from the support wall and defining a slot, wherein the at least one ring storage pendant is sized and configured to receive thereover a plurality of rings in a stacked condition, wherein the at least one ring storage pendant has an upper segment with a broader portion above a narrower portion, wherein the narrower portion is received in the slot of the fixture wall, and wherein the broader portion rests against an upper surface of the fixture wall.

15. The apparatus of claim 14 including a plurality of said mount fixtures each supporting a plurality of said ring storage pendants.

* * * * *